United States Patent [19]

Dubois et al.

[11] 4,136,796

[45] Jan. 30, 1979

[54] VENTED CLOSURE

[75] Inventors: Robert A. Dubois, Marion, Ohio; William H. Gushard, Staten Island, N.Y.

[73] Assignee: Greif Bros. Corporation, Delaware, Ohio

[21] Appl. No.: 633,907

[22] Filed: Nov. 20, 1975

Related U.S. Application Data

[63] Continuation of Ser. No. 459,970, Apr. 11, 1974, abandoned, which is a continuation of Ser. No. 270,310, Jul. 10, 1972, abandoned.

[51] Int. Cl.[2] ..... B65D 51/16; B65D 51/18

[52] U.S. Cl. ..... 220/256; 220/303; 220/371; 220/373

[58] Field of Search ..... 220/371, 367, 372, 303, 220/256, 63 R, 371, 373; 215/307-310

[56] References Cited

U.S. PATENT DOCUMENTS

| | | | |
|---|---|---|---|
| 1,159,687 | 11/1915 | Kraft | 137/526 |
| 1,409,902 | 3/1922 | Ausen | 230/372 |
| 1,949,979 | 3/1934 | Shera | 220/304 |
| 2,650,673 | 9/1953 | Bering et al. | 220/371 |
| 3,167,210 | 1/1965 | Carney, Jr. | 220/63 R |
| 3,219,230 | 11/1965 | Housz et al. | 220/63 |
| 3,243,071 | 3/1966 | Kimmel | 215/260 |
| 3,523,408 | 8/1970 | Rosenberg | 55/159 |

FOREIGN PATENT DOCUMENTS

| | | | |
|---|---|---|---|
| 494076 | 6/1950 | Belgium | 220/371 |

*Primary Examiner*—William Price
*Assistant Examiner*—Allan N. Shoap
*Attorney, Agent, or Firm*—Kane, Dalsimer, Kane, Sullivan and Kurucz

[57] ABSTRACT

A closure is provided for a container opening. The opening is defined by a neck extending outwardly from the top of the container. The closure includes a liner cap disposed both interiorly and exteriorly of the neck and defines a central passage. A plug extends across the top of the cap to close off the passage from the exterior. The plug is provided with at least one longitudinal hole. The lower end of the plug has attached thereto a membrane extending across the passage. This membrane does not permit liquids within the container to pass therethrough, but possesses the property of being capable of venting gasses therethrough. A dust cap may extend across the top of the closure during shipment and storage.

2 Claims, 5 Drawing Figures

VENTED CLOSURE

CROSS REFERENCE TO RELATED APPLICATON

This is a continuation application of Ser. No. 459,970 filed Apr. 11, 1974, now abandoned; which is a continuation of Ser. No. 270,310, filed July 10, 1972, abandoned.

BACKGROUND OF THE INVENTION

Many materials are packaged in containers or drums which liberate gasses during shipment and storage. Consequently, pressure within the container increases creating potentially dangerous conditions. Towards this end, the container may rupture or one of the seals may fail. Neighboring people may be injured or the container contents may thereafter be detrimentally affected.

SUMMARY OF THE INVENTION

It is a principal object of the present invention to provide an improved closure for containers or drums which permit the venting of gasses therein, while at the same time, preventing passage therethrough of liquids or other materials stored therein.

Another object is to provide a closure with a removable and replaceable plug bearing a membrane selective in its ability to pass gasses but not liquids; and should the membrane become damaged for one reason or another, a new plug with membrane need only be added to place the entire container in serviceable condition.

The foregoing and other objects are not advantageously attained by a vented closure adapted to be disposed over a neck defining opening of a container or drum. This closure includes a cap having two concentric flanges integrally connected at one end with both flanges being internally threaded. The internal threads of the outer flange are adapted to mesh with the external threads on the neck and the threads of the inner flange are adapted to receive external threads of a plug extending across the passage defined by the inner flange. The plug is provided with a membrane across its base. This membrane is of a porous nature to permit gas under pressure within the container to escape therethrough while, at the same time, not permitting any of the liquid contents to pass. The body of the plug may be provided with one or more openings to permit any gas that has been relieved through the membrane to escape therethrough. A protective dust cap may be fitted over the top of the closure during shipment and storage.

Other objects and advantages will become apparent from the following detailed description which is to be taken in conjunction with the accompanying drawings.

DETAILED DESCRIPTION OF THE PREFERRED EMBODIMENT

Figure 1:
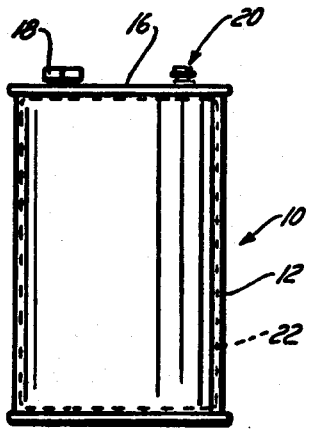
FIG. 1 is an elevational view of a container or drum having incorporated therein the improved vented closure of the present invention.
Figure 2:
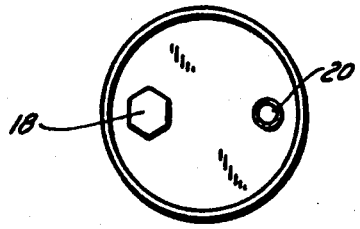
FIG. 2 is a top plan view thereof.
Figure 3:
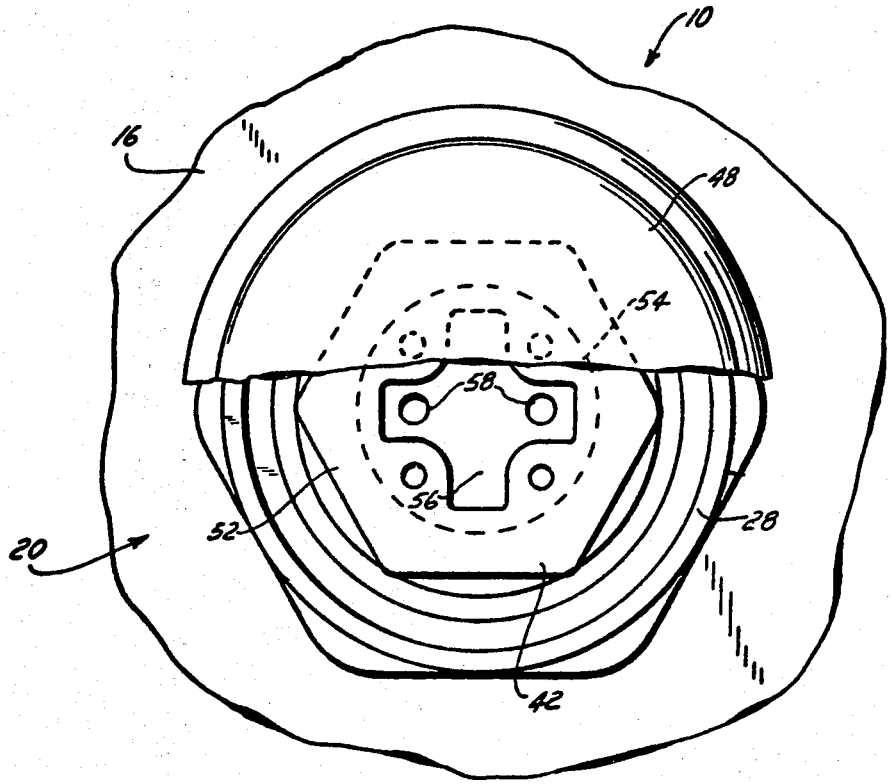
FIG. 3 is an enlarged fragmentary plan view of the vented closure with certain parts broken away and removed and others sectioned for clarity.
Figure 4:
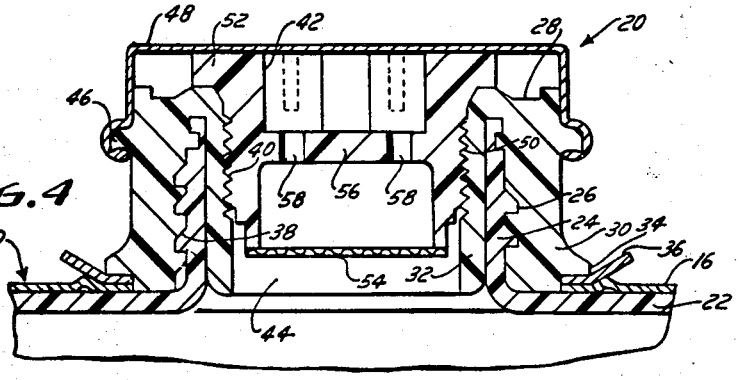
FIG. 4 is a longitudinal section taken through the improved vented closure.
Figure 5:
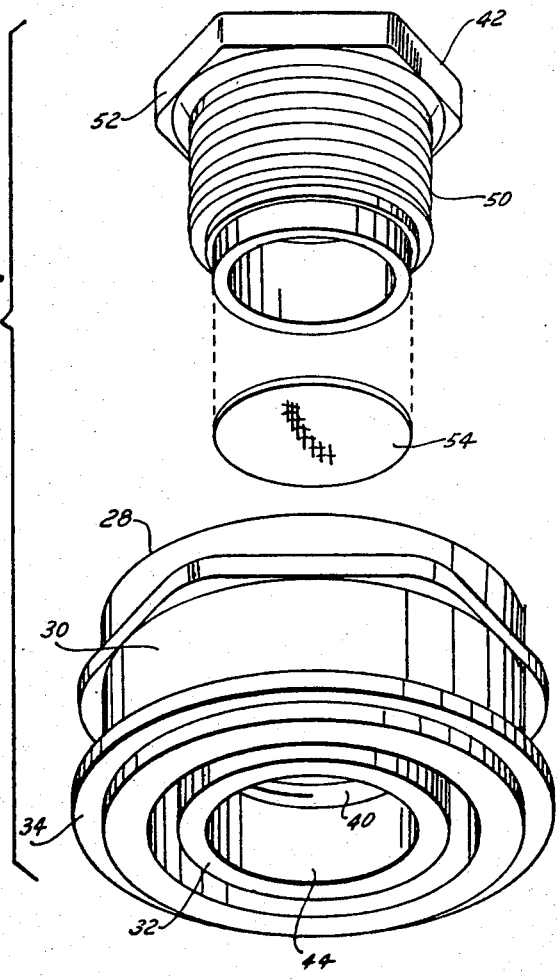
FIG. 5 is an exploded perspective view thereof.

In the drawings a container or drum 10 includes a tubular or cylindrical body shell 12 sealed at its base by bottom closure 14 and at its upper end by top or head closure 16. The top closure 16 may include a bung opening for access to the container interior for filling and emptying its contents. This bung opening may be sealed by a closure 18. In addition, the top closure 16 may have associated therewith a vented closure 20 possessing the attributes of the present inventon, notably the venting of gas from within the drum interior to alleviate buildup of pressure therein while at the same time the preventing free discharge therethrough of the container contents, particulary liquids.

Drum 10 may be a fiber, steel or plastic drum or any combination thereof; and for purposes of the explanation of the present invention, a plastic-lined drum has been illustrated. Thus, the drum 10 includes a plastic liner 22 having an upstanding integral neck 24 having external threads 26.

The vented closure 20 is shown associated with the neck 24 to permit the venting of gasses within the container and particularly the pressure buildup thereof while preventing any liquid content thereof from discharging from the container. This closure includes a liner cap 28 having an outer cylindrical flange 30 integrally connected at its top with an inner concentric flange 30. The outer flange 30 includes a circumferentially extending outer rib 34 which cooperates with associated surfaces of the top closure 16 in sealing the juncture between these two parts through the interposition of the seal 36. The outer flange 30 is furnished with internal threads 38 which mesh with the external threads 26 of the neck 24 which is adapted to be conveniently interposed between the inner and outer flanges 30 and 32, respectively, of the cap 28. The inner flange 32 is provided with internal threads 40 for threadedly receiving the plug 42 for sealing the inner passage 44 of the cap. The outer flange 30 is provided with a further circumferentially extending rib 46 adjacent the top thereof for receiving the skirt of a dust cap 48 to protect the closure 20 during shipping and storage.

The plug 42 is provided with external threads 50 for meshing with the internal threads 40 of the inner flange 32 of the cap 28 to thereby close off the passage 44. The plug 42 also has a radially extending lip 52 which engages with the top of the cap 28 to not only seal this juncture but to prevent the plug from being threaded too far within the passage 44. The base of the plug 42 has attached thereto a circular membrane 54 which is selective in its ability to pass gasses and not liquids. Toward this end the central disc portion 56 of the plug 42 is provided with one or more holes 58 which direct the vented gasses to the ambient.

Thus, this membrane 54 is porous to gas under pressure but not liquids. In a successful application of the present invention membrane 54 possessed a 3 micron mesh. In this connection, satisfactory results have been obtained when the membrane 54 was cut from a cloth fabricated from fluorocarbon filaments. Material of this type offers advantages because of its relative inertness to a number of materials including hydrogen peroxide and other compounds which might be shipped in lined containers. Membrane 54 may be secured in place on the plug 42 in any number of ways including by insert molding. In this regard, the plug is molded with the membrane 54 in the mold and the hot melt is permitted to penetrate the pores of the membrane thereby providing a mechanical bond between the associated surfaces.

The present invention contemplates the application of membrane 54 at other locations of the closure 20 but its application to plug 42 offers a number of advantages. For example, if the membrane 54 is damaged, a new plug 42 could be employed with a new diaphragm on it and the container would then be continued in use in a serviceable condition.

Thus the several aforenoted objects and advantages are most effectively attained. Although a single somewhat preferred embodiment of the invention has been disclosed and described in detail here, it should be understood that this invention is in no sense limited thereby and its scope is to be determined by that of the appended claims.

What is claimed is:

1. A molded plastic vented closure for a container having a molded plastic liner neck defining an opening comprising a plug for extending across an opening in a container, the plug including an upper end and comprising a body with a passage extending longitudinally therethrough, means on said body for connecting to the container across said opening; an integral flat disc extending across said passage longitudinally spaced apart from said upper end and having a plurality of apertures, the plug including a bottom end, and a porous relatively inert, easily damaged fluorocarbon flat cloth membrane of 3 micronmesh fabricated from fluorocarbon filaments associated with the closure below the disc and across said passage to permit venting of gasses therethrough and out said passage through the disc apertures into the ambient and preventing passage therethrough of a liquid, the membrane extends across the plug bottom end longitudinally spaced apart from said disc and being connected to the plug bottom with the plastic of the associated surfaces of the plug penetrating the pores of the engaged surface portion of the membrane thereby providing a mechanical bond between the associated surfaces of the plug and membrane, the disc protecting the membrane from rupture, and the vented closure including a cap for coupling with the neck defining the opening of the container, the cap including an inner and outer integrally connected concentric flange both of which have internal threads, the threads of the outer flange adapted to mesh with corresponding threads on the exterior of the neck of the container, the connecting means of the plug including external threads, and the threads on the inner flange mating with threads of the plug, and a radial lip on the top of the plug for sealing with the top of the cap and preventing the plug from being threaded too far into the cap.

2. The invention in accordance with claim 1, wherein a dust cap extends over the end of the cap and the plug.

* * * * *